US012378039B2

(12) United States Patent
Lee et al.

(10) Patent No.: US 12,378,039 B2
(45) Date of Patent: Aug. 5, 2025

(54) CONTAINER

(71) Applicant: KOLMAR KOREA CO., LTD., Sejong-si (KR)

(72) Inventors: Chang Soo Lee, Sejong-si (KR); Koo Sup Ahn, Sejong-si (KR); Hye Jin Jung, Sejong-si (KR); Hee Yoon Kim, Sejong-si (KR); Eun Ji Jeong, Sejong-si (KR)

(73) Assignee: KOLMAR KOREA CO., LTD., Sejong-si (KR)

( * ) Notice: Subject to any disclaimer, the term of this patent is extended or adjusted under 35 U.S.C. 154(b) by 385 days.

(21) Appl. No.: 17/994,244

(22) Filed: Nov. 25, 2022

(65) Prior Publication Data

US 2023/0090075 A1 Mar. 23, 2023

Related U.S. Application Data

(63) Continuation of application No. PCT/KR2021/003086, filed on Mar. 12, 2021.

(30) Foreign Application Priority Data

May 25, 2020 (KR) ..... 20-2020-0001732

(51) Int. Cl.
*B65D 35/36* (2006.01)
*A45D 34/04* (2006.01)
(Continued)

(52) U.S. Cl.
CPC ..... *B65D 35/36* (2013.01); *A45D 34/04* (2013.01); *A45D 40/26* (2013.01); *B65D 35/38* (2013.01)

(58) Field of Classification Search
CPC ..... B65D 35/36; B65D 35/38; A45D 33/02; A45D 34/04; A45D 40/26; A45D 2200/054
(Continued)

(56) References Cited

U.S. PATENT DOCUMENTS 4,211,501 A * 7/1980 Pedroso ..... B05C 17/00516 401/265
6,572,300 B2 * 6/2003 Altonen ..... A45D 34/04 401/265
(Continued)

FOREIGN PATENT DOCUMENTS

EP 3571954 A1 11/2019
JP S56-3874 U 1/1981
(Continued)

*Primary Examiner* — David J Walczak
(74) *Attorney, Agent, or Firm* — Bridgeway IP Law Group, PLLC; Sang Ho Lee; Hyun Woo Shin

(57) ABSTRACT

A content container includes: a container unit for accommodating content; a discharge unit provided in the upper end of the container unit and having a lower discharge hole formed therein, through which the content is discharged; and an application unit including an elastic material, wherein the application unit is provided in the upper end of the discharge unit, has an upper discharge hole formed therein, the upper discharge hole being in communication with the lower discharge hole, and applies the content discharged through the upper discharge hole on the skin of a user.

17 Claims, 7 Drawing Sheets

(51) Int. Cl.
*A45D 40/26* (2006.01)
*B65D 35/38* (2006.01)

(58) Field of Classification Search
USPC ..... 401/183–186, 262, 265
See application file for complete search history.

(56) References Cited

U.S. PATENT DOCUMENTS

| | | | | |
|---|---|---|---|---|
| 7,281,876 | B2 * | 10/2007 | Kwon | B65D 47/42 401/265 |
| 7,374,361 | B1 | 5/2008 | Kwon | |
| 2008/0138145 | A1 | 6/2008 | Kwon | |
| 2010/0262051 | A1 | 10/2010 | De Laforcade | |
| 2011/0176853 | A1 | 7/2011 | Sasada et al. | |

FOREIGN PATENT DOCUMENTS

| | | | |
|---|---|---|---|
| JP | S60-80719 | U | 6/1985 |
| JP | 2003-205961 | A | 7/2003 |
| JP | 2012-231920 | A | 11/2012 |
| JP | 2017-533154 | A | 11/2017 |
| JP | 2019-151374 | A | 9/2019 |
| KR | 10-1411990 | B1 | 6/2014 |
| KR | 10-1473191 | B1 | 12/2014 |
| KR | 20-0484966 | Y1 | 11/2017 |
| KR | 20-0492726 | Y1 | 12/2020 |
| WO | 2013/111932 | A1 | 8/2013 |

* cited by examiner

CONTAINER

CROSS-REFERENCE TO RELATED APPLICATIONS

The present application is a continuation application of PCT/KR2021/003086 filed on Mar. 12, 2021, and claims priority to Korean patent application number 20-2020-0001732 filed on May 25, 2020, the entire contest of which are incorporated by reference herein.

TECHNICAL FIELD

The present invention relates to a content container, and particularly, to a content container having an application part made of an elastic material.

BACKGROUND ART

Makeup is used to make a beautiful part of a body stand out and to supplement a weakness of the body, and thus to make the appearance appear healthier and more beautiful. Various formulations or cosmetic ingredients are used for makeup to improve use feeling or efficacy. For example, moisture or volatile substances may be included in a content to increase soft and moist use feeling or an absorption force, or skin active ingredients such as vitamins may be included.

In general, when such contents are used, a method of discharging a content accommodated in a cosmetic container and then applying the content to a skin using a hand or a tool (a brush, a puff, and the like) is used.

However, when the hand is used, hygiene is poor or the content may be lost. Further, even when a tool is used, there is a hassle to always carry the tool to apply the content, and a residual content may remain in the tool, resulting in loss of the content.

DISCLOSURE

Technical Problem

The present invention is directed to providing a content container having an application part made of an elastic material.

The technical aspects of the present invention are not limited to the aspects described above, and those skilled in the art will clearly understand other technical aspects not described from the following descriptions.

Technical Solution

According to embodiments of the present invention, a content container is provided. One aspect of the present invention provides the content container including a container part in which a content is accommodated, a discharge part which is provided at an upper end of the container part and has therein a lower discharge hole through which the content is discharged, and an application part made of an elastic material, which is provided at an upper end of the discharge part, has therein an upper discharge hole communicating with the lower discharge hole, and applies a content discharged through the upper discharge hole onto a skin of a user.

An inner diameter of the lower discharge hole may be decreased toward an upper side.

A support portion protruding toward the application part may be formed at an upper end of the discharge part, the support portion may be retracted into a lower inner side of the application part, and an inner surface and an outer surface of the support portion may be in close contact with the application part.

The application part may include an inner wall formed to protrude from a lower end thereof to be in contact with the inner surface of the support portion, an outer wall protruding to be in contact with the outer surface of the support portion, and a retraction groove formed between the inner wall and the outer wall such that the support portion is inserted thereinto.

An outer seating portion with which a bottom surface of the outer wall of the application part is in close contact may be formed outside the support portion.

An inner seating portion with which a bottom surface of the inner wall of the application part is in close contact may be formed inside the support portion.

An inner diameter of the upper discharge hole may be made to be smaller than an inner diameter of the lower discharge hole due to the inner wall.

An inclined lower application surface may be formed on an outer surface of the discharge part, an inclined upper application surface may be formed on an outer surface of the application part, and the lower application surface and the upper application surface may be continuous with each other.

The lower discharge hole and the upper discharge hole may be formed in a rectangular shape.

The content container may further include a cover part that is detachably coupled to the discharge part and opens or closes the upper discharge hole, wherein, when the cover part is coupled to the discharge part, a bottom surface of the cover part may be pressed in close contact with the discharge hole.

At least one coupling protrusion may be formed along a circumference on a lower surface of the discharge part such that the discharge part is vertically fit-coupled to the cover part. The discharge part and the application part may be integrally formed by double injection.

Advantageous Effects

According to the present invention, an application part made of an elastic material is provided at an upper end of a discharge part to provide a warm use feeling and gently bent and thus the content can be applied naturally.

Further, according to the present invention, an inner diameter of the discharge hole is reduced toward an upper side, and thus a bottleneck phenomenon is caused, so that the content can be prevented from being excessively discharged.

Further, according to the present invention, through the rectangular discharge hole, the content can be discharged more widely and can be easily applied.

Further, according to the present invention, a continuous inclined application surface is formed outside the discharge part and the application part to allow an application to be easily.

Further, according to the present invention, a support portion of the discharge part, an inner wall and an outer wall of the application part, and a retraction groove are coupled to each other, so that the application part can be more firmly coupled to the discharge part, and the application part can be supported against an external force.

Further, according to the present invention, a cover part can seal a content while an upper discharge hole is pressed in close contact therewith, can prevent excessive deformation of the application part during the pressing, and can be fit-coupled in a vertical direction to restore the shape thereof.

DESCRIPTION OF DRAWINGS

A brief description of each drawing is provided to fully understand the drawings cited in detailed description of the present invention.

MODES OF THE INVENTION

Figure 1:
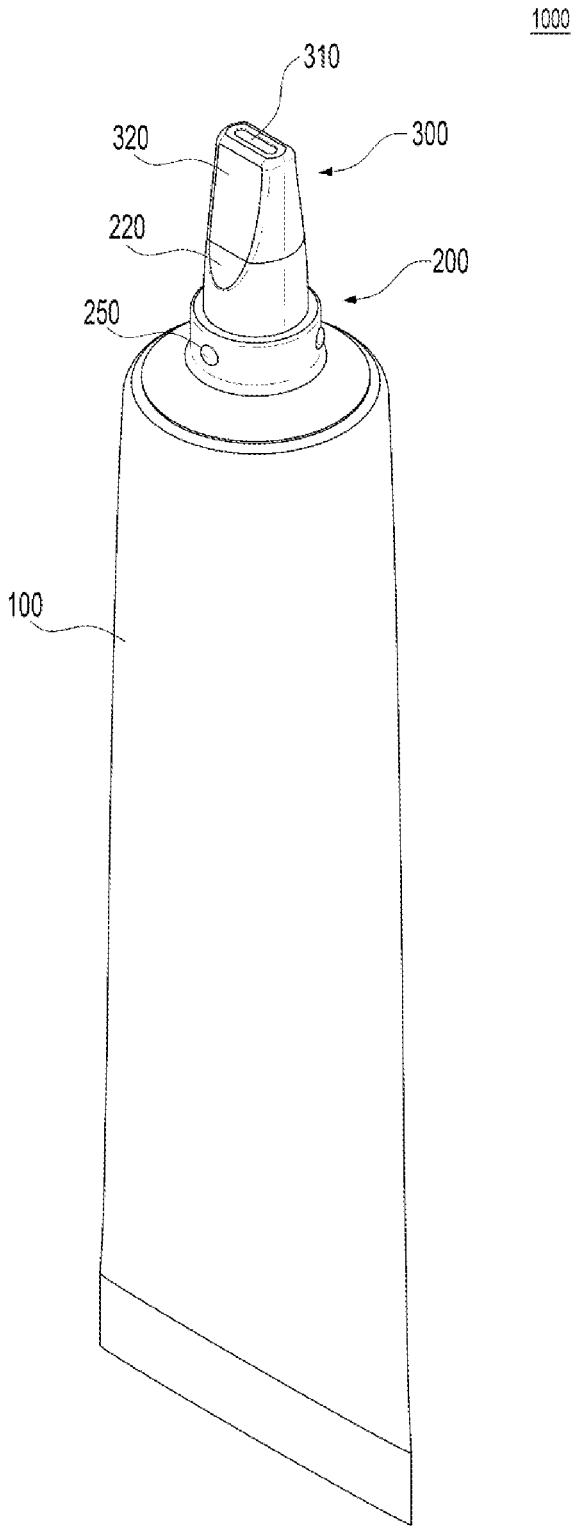
FIG. 1 is a perspective view of a content container according to an embodiment of the present invention.

Hereinafter, embodiments according to the present invention will be described with reference to the accompanying drawings. In adding the reference numerals to the components of each drawing, it should be noted that the identical or equivalent component is designated by the identical numeral even when they are displayed on other drawings. Further, in describing the embodiment of the present invention, a detailed description of the related known configuration or function will be omitted when it is determined that it interferes with the understanding of the embodiment of the present invention. Further, it is apparent that, although the embodiments of the present invention will be described below, the technical spirit of the present invention is not limited thereto and may be modified and variously implemented by those skilled in the art. Meanwhile, hereinafter, for convenience of description, the up, down, left, and right directions are based on the drawings, and the scope of the present invention is not necessarily limited to the corresponding directions.

Throughout the specification, when a first part is connected to a second part, this includes not only a case in which the first part is "directly connected" to the second part but also a case in which the first part is "indirectly connected" to the second part with a third part interposed therebetween. Throughout the specification, when a part "includes" a component, this means that another component is not excluded but may be further included unless otherwise stated. Further, in the description of components of the embodiments of the present invention, the terms such as first, second, A, B, (a) and (b) may be used. These terms are merely intended to distinguish the components from other components, and the terms do not limit the nature, order or sequence of the components.

Figure 2:
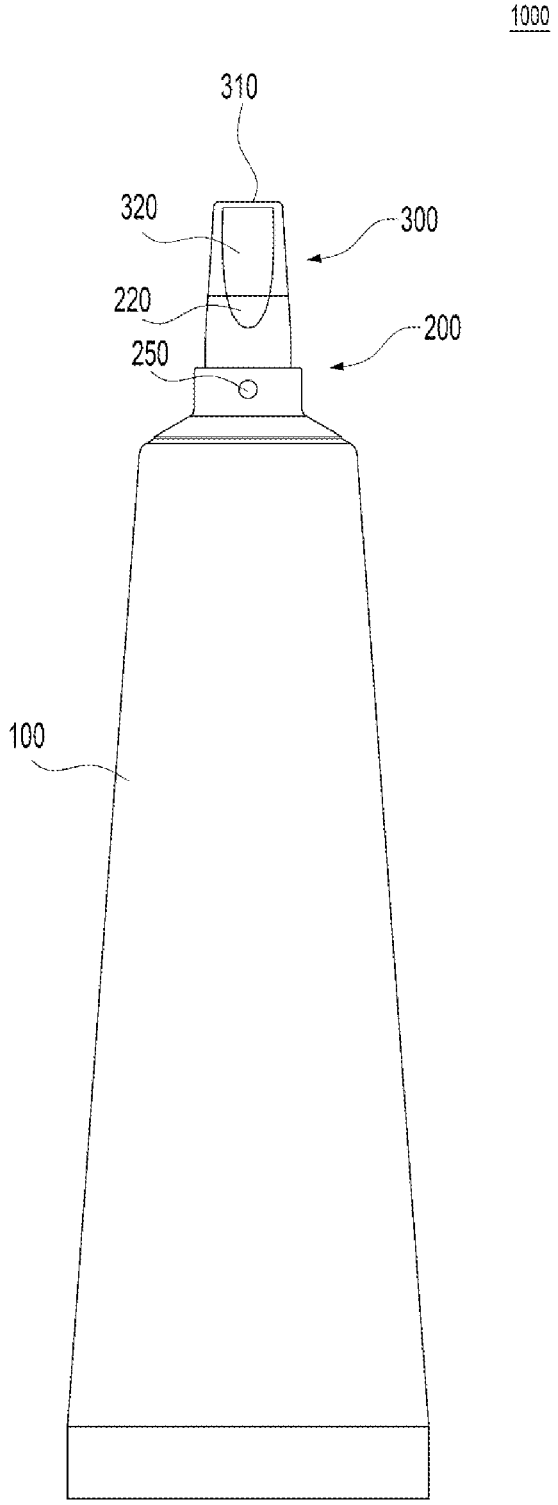
FIG. 2 is a front view of the content container according to the embodiment of the present invention.
Figure 3:
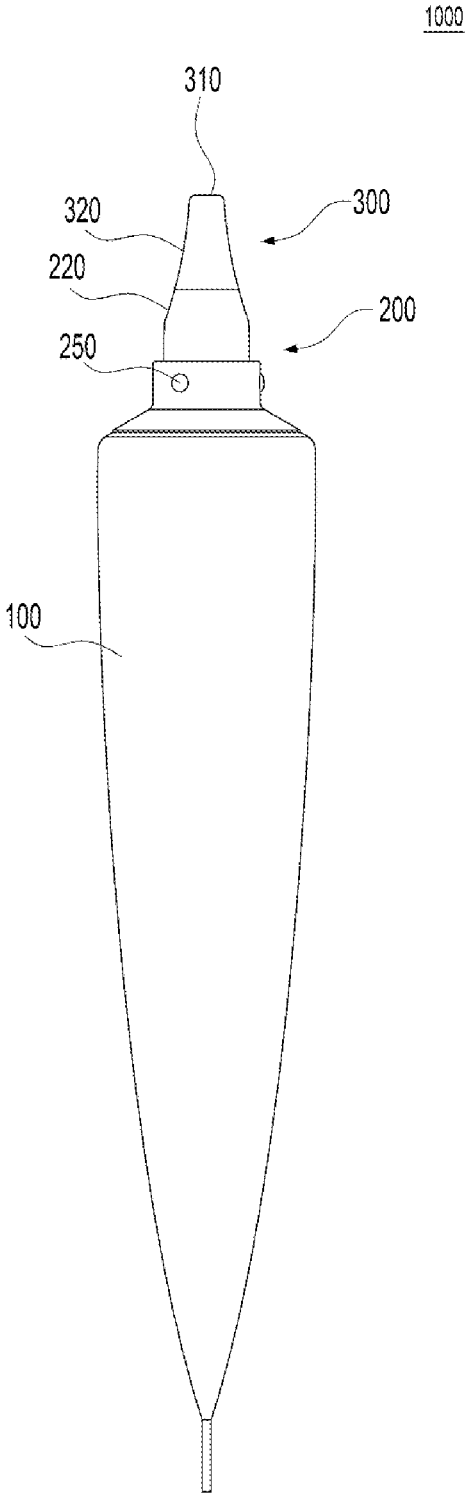
FIG. 3 is a side view of the content container according to the embodiment of the present invention.
Figure 4:
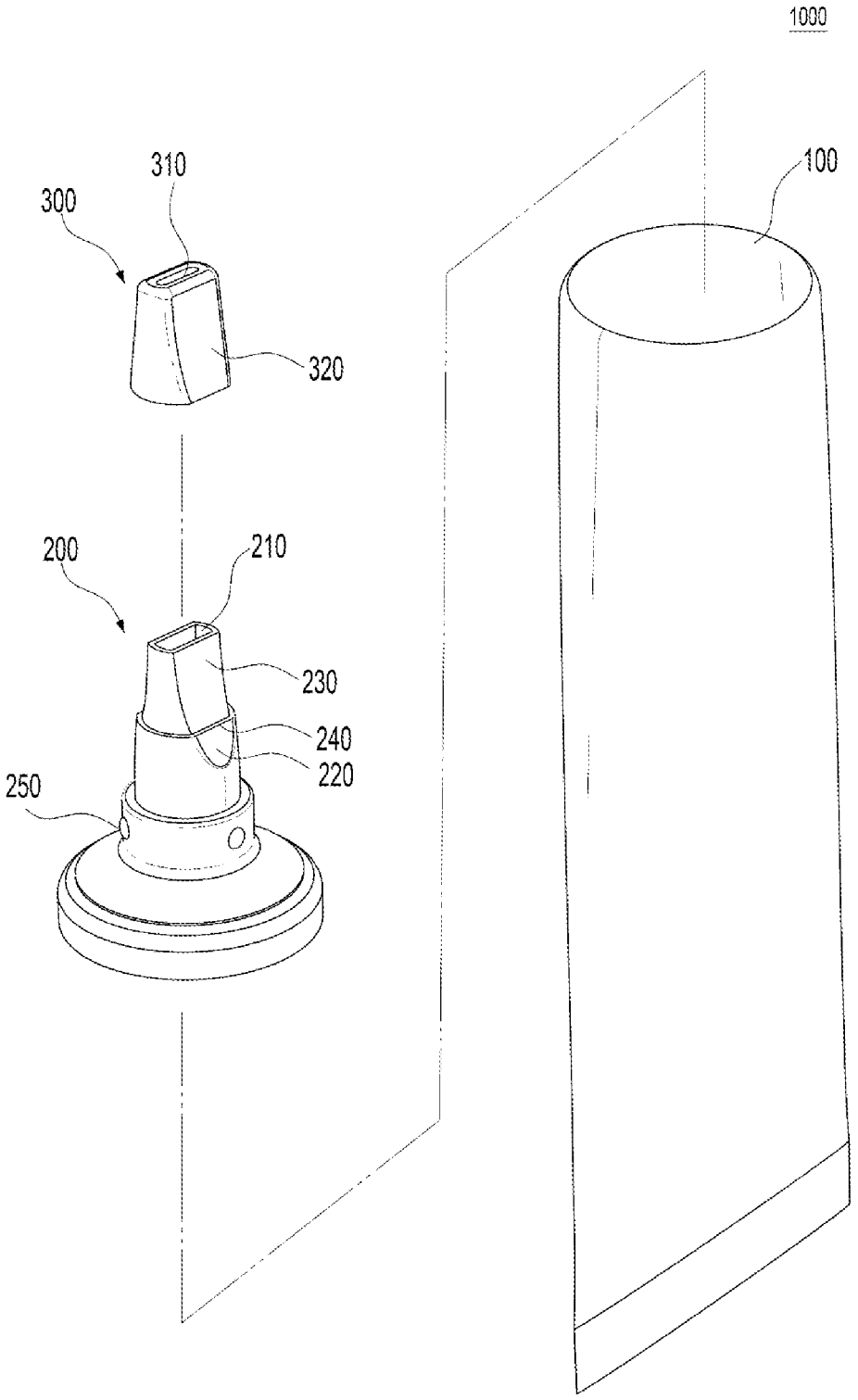
FIG. 4 is an exploded view of the content container according to the embodiment of the present invention.
Figure 5:
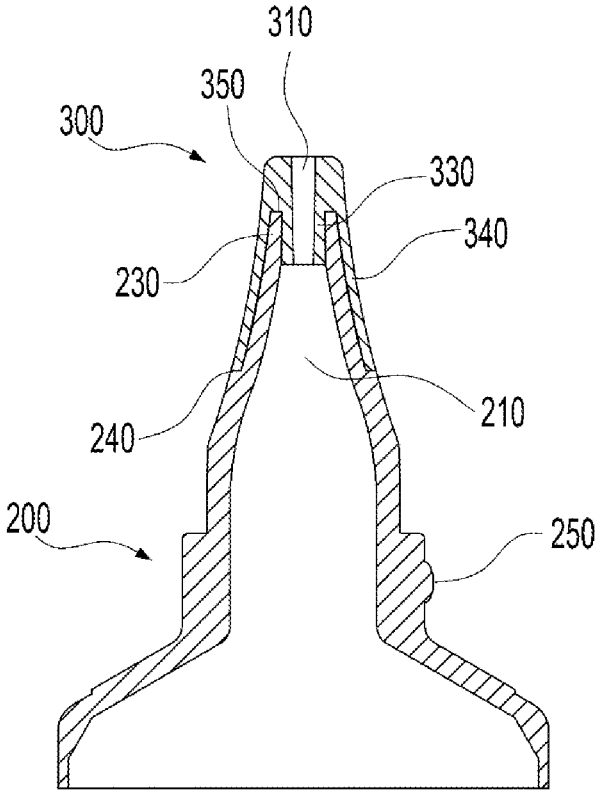
FIG. 5 is a partial cross-sectional view of the content container according to the embodiment of the present invention.

FIG. 1 is a perspective view of a content container according to an embodiment of the present invention, FIG. 2 is a front view of the content container according to the embodiment of the present invention, FIG. 3 is a side view of the content container according to the embodiment of the present invention, FIG. 4 is an exploded view of the content container according to the embodiment of the present invention, and FIG. 5 is a partial cross-sectional view of the content container according to the embodiment of the present invention.

Referring to FIGS. 1 to 5, a content container 1000 may include a container part 100, a discharge part 200, and an application part 300.

The container part 100 may accommodate a content, and to this end, may have an accommodation space having an open upper portion. Here, the content may be liquid, gel, or powder cosmetics. For example, the content may include a lotion, a milk lotion, a moisture lotion, a nourishing lotion, a skin lotion, a skin softener, a skin toner, an astringent, a massage cream, a nourishing cream, a moisture cream, a whitening essence, a tone-up cream, a sunscreen, a sun cream, a sun milk, a BB cream, a base, a foundation, a CC cream, a concealer, a blusher, a shading, an eye shadow, an eyebrow, an eye cream, a primer, and the like. However, the present invention is not limited thereto, and other formulations or types of cosmetics, medical contents, and the like may be applied. A material of the container part 100 may be soft or hard, and for example, the container part 100 may be implemented as a tube type. However, the present invention is not limited thereto.

The discharge part 200 may be provided at an upper end of the container part 100, and the content in the container part 100 may be discharged through the discharge part 200. To this end, a lower discharge hole 210 may be formed to pass through the inside of the discharge part 200. The content introduced through the lower discharge hole 210 may be discharged through an upper discharge hole 310 of the application part 300. For example, a material of the discharge part 200 may include polypropylene, polyethylene, polystyrene, polyethylene terephthalate, polylactic acid, and the like. However, the present invention is not limited thereto.

The application part 300 may be provided at an upper end of the discharge part 200, and an upper discharge hole 310 communicating with the lower discharge hole 210 may be formed inside the application part 300. The content introduced through the lower discharge hole 210 may be discharged to the outside through the upper discharge hole 310. Further, the application part 300 may apply the content discharged through the upper discharge hole 310 onto a skin of a user while in contact with the skin.

The application part 300 may have an elastic material. This allows the content to be applied naturally while providing a warm use feeling and gently bending the application part 300. A material of the application part 300 may include, for example, natural rubber, spandex, butyl rubber, elastomer, fluoroelastomer, thermoplastic elastomer, ethylene-propylene rubber, restyline, thermoplastic styrene-butadiene rubber, styrene-butadiene rubber, elastin, chloroprene, isoprene rubber, foil butadiene, nitrile rubber, terpene, silicone rubber, acrylic rubber, polyethylene, low density polyethylene, linear low density polyethylene, high density polyethylene, and the like. However, the present invention is not limited thereto.

In the embodiment, in order to discharge the content, the material of the container part 100 may be relatively soft, and the material of the discharge part 200 may be relatively hard. However, the present invention is not limited thereto.

In the embodiment, the material of the discharge part 200 may be relatively hard as compared to the application part 300. This is for stably supporting the application part 300 even when an external force is applied to the application part 300. However, the present invention is not limited thereto.

In the embodiment, an inner diameter of the lower discharge hole 210 may be decreased from a lower side toward an upper side thereof. Thus, a bottleneck phenomenon is caused toward the upper side in the lower discharge hole 210, so that the content can be prevented from being excessively discharged.

In the embodiment, an inner diameter of the upper discharge hole 310 may be smaller than the inner diameter of the lower discharge hole 210. In this case, the inner diameter of the upper discharge hole 310 may be partially constant or may be gradually decreased toward the upper side.

In the embodiment, the lower discharge hole 210 and the upper discharge hole 310 may be formed in a rectangular shape. That is, one side (a long side) is formed longer than the other side (a short side) adjacent to the one side, so that the content can be discharged more widely and can be easily applied.

In the embodiment, the cross section of the discharge part 200 is decreased toward the upper side, so that an inclined lower application surface 220 may be formed on an outer surface thereof. Further, the cross section of the application part 300 is decreased toward the upper side, so that an inclined upper application surface 320 may be formed on an outer surface thereof. The inclined lower application surface 220 and the inclined upper application surface 320 may be located on the long sides of the lower discharge hole 210 and the upper discharge hole 310 having a rectangular shape and may be continuous with each other.

In the embodiment, a support portion 230 protruding toward the application part 300 may be formed at an upper end of the discharge part 200. Correspondingly, the application part 300 may include an inner wall 330 protruding from a lower end thereof to be in contact with an inner surface of the support portion 230, an outer wall 340 protruding to be in contact with an outer surface of the support portion 230, and a retraction groove 350 formed between the inner wall 330 and the outer wall 340 such that the support portion 230 is inserted thereinto.

The support portion 230 is inserted into a lower inner side (particularly, the retraction groove 350) of the application part 300, so that the inner surface and the outer surface of the support portion 230 may be in close contact with the application part 300 (particularly, the inner wall 330 and the outer wall 340). By enlarging a bonding area, a bonding strength between the discharge part 200 and the application part 300 can be improved, and even when an external force is applied to the application part 300 in a lateral direction, the support portion 230 can support the application part 300 to prevent shaking or separation.

Figure 6:
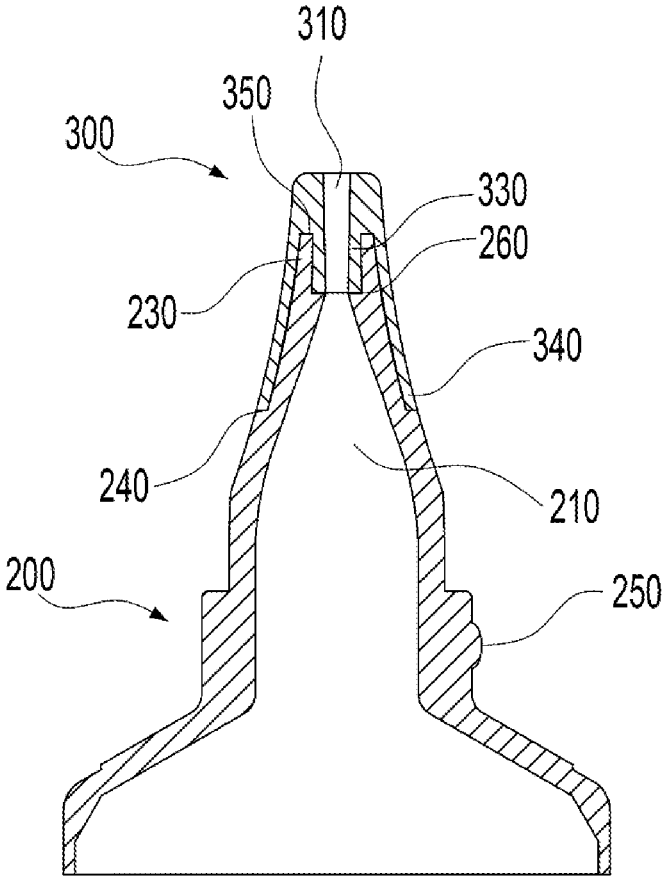
FIG. 6 is a partial cross-sectional view of the content container according to another embodiment of the present invention.

In the embodiment, an outer seating portion 240 with which a bottom surface of the outer wall 340 of the application part 300 is in close contact may be formed outside the support portion 230. Additionally or alternatively, as shown in FIG. 6, an inner seating portion 260 with which a bottom surface of the inner wall 330 of the application part 300 is in close contact may be formed inside the support portion 230. The outer seating portion 240 and/or the inner seating portion 260 can support the outer wall 340 and/or the inner wall 330 of the application part 300 and increase the bonding strength.

In the embodiment, the inner diameter of the upper discharge hole 310 may be smaller than the inner diameter of the lower discharge hole 210 due to the inner wall 330. The inner diameter of the upper discharge hole 310 may be partially constant or may be gradually decreased. In the latter case, an inclined surface for the gradual decrease of the inner diameter may be formed on an inner surface of the inner wall 330.

Figure 7:
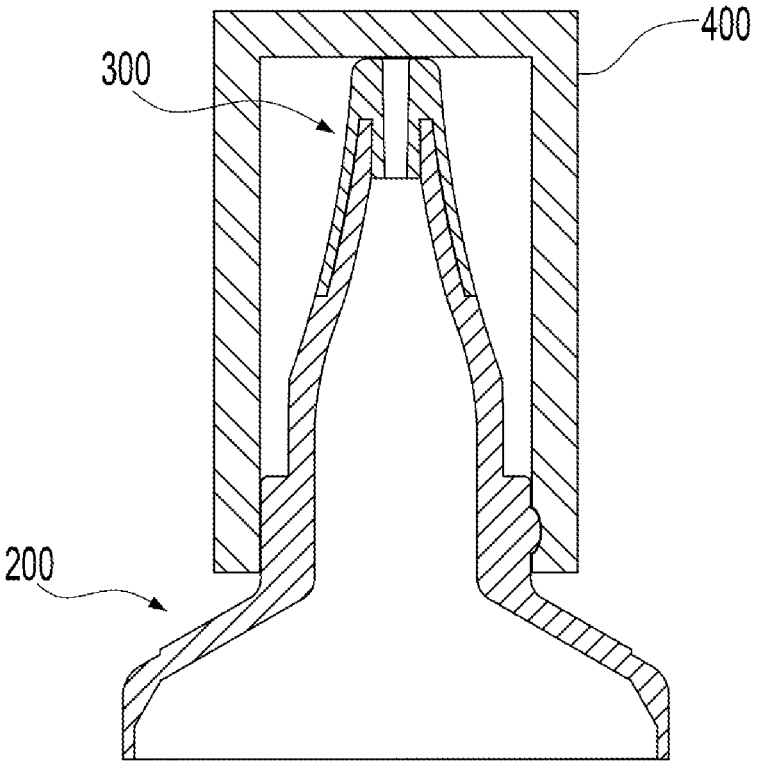
FIG. 7 is a partial cross-sectional view of the content container according to yet another embodiment of the present invention.

According to an embodiment as shown in FIG. 7, the content container 1000 may further include a cover part 400 that is detachably coupled to the discharge part 200 and opens or closes the upper discharge hole 310 of the application part 300. When the cover part 400 is coupled to the discharge part 200, a bottom surface of the cover part 400 is pressed into close contact with the upper discharge hole 310 so that the content can be sealed. In this case, the close contact may be strong close contact to the extent that an upper end of the application part 300 made of an elastic material is partially deformed. However, the present invention is not limited thereto.

In the embodiment, a sealing part may protrude from the bottom surface of the cover part 400. When the cover part 400 is coupled to the discharge part 200, the sealing part may press and come into contact with the upper end of the application part 300. In this case, the sealing part may have a shape corresponding to the upper end of the application part 300. For example, the sealing part may be formed to protrude in a rectangular shape to surround the upper end of the application part 300. Further, for example, the sealing part may be formed to protrude in a rectangular shape to be inserted into the upper discharge hole 310 of the application part 300.

In the embodiment, the cover part 400 and the discharge part 200 may be fit-coupled to each other. In particular, the cover part 400 and the discharge part 200 may be fit-coupled to each other in a vertical direction, and to this end, a coupling part 250 may be formed along a circumference of a lower surface of the discharge part 200. For example, the coupling part 250 may include at least one coupling protrusion and/or coupling groove protruding in a horizontal direction along a circumference thereof. A coupling protrusion and/or coupling groove corresponding to the coupling protrusion of the coupling part 250 may be formed on an inner surface of the cover part 400 as well. Since the cover part 400 and the discharge part 200 are fit-coupled in a vertical direction, the application part 300 made of an elastic material is also pressed downward, and thus a shape of the application part 300 can be easily restored when the cover part 400 is separated.

In the embodiment, the discharge part 200 and the application part 300 may be formed as separate members and may be coupled to each other in various manners. For example, the discharge part 200 and the application part 300 may be implemented in various manners such as assembling (screw coupling, fit-coupling, fastening coupling, and the like, an adhesive material, external heat bonding in which heat is applied from the outside (through a heating/pressing member), and internal heat bonding in which heat is generated from the inside (through an ultrasound, a low frequency vibration, and the like). When the assembling is used, various components, such as threads, protrusions, grooves and the like, corresponding to each other may be provided in the discharge part 200 and the application part 300.

In the embodiment, the discharge part 200 and the application part 300 may be formed integrally. For example, the discharge part 200 and the application part 300 may be made of different materials and may be integrally formed by double injection (or insert molding). In the case of the double injection (or the insert molding), the discharge part 200 may be first molded (that is, primarily molded), and the application part 300 may be molded (that is, secondarily molded) for this. In particular, a molding time and a pressure during the secondary molding can be increased as compared to the primary molding to increase a bonding force between the discharge part 200 and the application part 300. However, the present invention is not limited thereto. By such double injection (or the insert molding), the discharge part 200 and the application part 300 are integrally formed without a separate bonding unit, so that the content container 1000 can be easily manufactured, and the bonding force between the application part 300 and the discharge part 200 and the durability thereof can be improved.

As described above, optimal embodiments have been disclosed in the drawings and the specification. Although specific terms are used herein, the terms are used only for describing the present invention and are not used to limit the meaning or the scope of the present invention described in the appended claims. Therefore, it should be understood by those skilled in the art that various modifications and other equivalent embodiments are possible therefrom. Thus, the true technical scope of the present invention should be determined by the technical spirit of the appended claims.

The invention claimed is:

1. A container comprising:

a container part configured to accommodate a content;

a discharge part disposed at an upper end of the container part and having therein a lower discharge hole through which the content is discharged;

an application part made of an elastic material, disposed at an upper end of the discharge part, and having therein an upper discharge hole communicating with the lower discharge hole, wherein the application part is configured to apply the content discharged through the upper discharge hole onto a skin of a user; and a support portion, the support portion protruding toward the application part and disposed at the upper end of the discharge part made of hard material, wherein the support portion is retracted into a lower inner side of the application part so that an inner surface and an outer surface of the support portion are in close contact with the application part, wherein the application part has a tapered cross-section upward, thereby defining an inclined upper application surface on long sides of outer surfaces thereof, wherein the application part includes an inner wall protruding to be in contact with the inner surface of the support portion and an outer wall protruding to be in contact with the outer surface of the support portion, and wherein the support portion is inserted into a groove disposed between the inner wall and the outer wall so that the support portion is configured to support the application part to prevent separation and allow for the application part to be bent laterally when the content is applied by the inclined upper application surface.

2. The container of claim 1, wherein an inner diameter of the lower discharge hole decreases toward an upper side thereof.

3. The container of claim 1, wherein the application part comprises:

the inner wall protruding from a lower end thereof to be in contact with the inner surface of the support portion;

the outer wall protruding to be in contact with the outer surface of the support portion; and a retraction groove defined between the inner wall and the outer wall and the support portion is inserted therein.

4. The container of claim 3, wherein an outer seating portion with which a bottom surface of the outer wall of the application part is in close contact is defined on the outer surface of the support portion.

5. The container of claim 3, wherein an inner seating portion with which a bottom surface of the inner wall of the application part is in close contact is defined on the inner surface of the support portion.

6. The container of claim 3, wherein an inner diameter of the upper discharge hole is smaller than the inner diameter of the lower discharge hole due to the inner wall of the application part.

7. The container of claim 1, wherein the lower discharge hole and the upper discharge hole have a rectangular shape.

8. The container of claim 1, further comprising a cover part that is detachably coupled to the discharge part and opens or closes the upper discharge hole, wherein, when the cover part is coupled to the discharge part, a bottom surface of the cover part is in close contact with the upper discharge hole.

9. The container of claim 8, wherein at least one coupling protrusion is formed along a circumference of a lower surface of the discharge part and the discharge part is vertically fit-coupled to the cover part through the at least one coupling protrusion.

10. The container of claim 1, wherein the discharge part and the application part are integrally formed by double injection.

11. The container of claim 1, wherein the discharge part and the application part have a tapered cross-section upward, thereby defining an inclined lower application surface and the inclined upper application surface on the long sides of the outer surfaces thereof, and the inclined lower application surface and the inclined upper application surface are continuous with each other.

12. The container of claim 1, wherein a material of the discharge part is harder as compared to a material of the application part.

13. The container of claim 1, wherein the application part made of the elastic material is configured to be gently bent when an external force is applied to the application part in a lateral direction.

14. The container of claim 1, further comprises a cover part that is detachably coupled to the discharge part and is configured to open or close the upper discharge hole of the application part.

15. The container of claim 14, wherein, when the cover part is coupled to the discharge part, an upper end of the application part made of the elastic material is configured to be partially deformed.

16. The container of claim 14, wherein the cover part and the discharge part are fit-coupled to each other in a vertical direction.

17. The container of claim 15, wherein, when the cover part is separated from the discharge part, the application part deformed is configured to be easily restored.

* * * * *